United States Patent [19]

Tanaka et al.

[11] Patent Number: 4,785,782

[45] Date of Patent: Nov. 22, 1988

[54] CONTROL APPARATUS OF A THROTTLE VALVE IN AN INTERNAL COMBUSTION ENGINE

[75] Inventors: Sinichiro Tanaka; Sinichi Matsumoto, both of Susono; Yukiya Katoh, Chita; Sunao Kitamura; Takeru Yasuda, both of Nagoya; Keiji Aoki, Susono, all of Japan

[73] Assignee: Toyota Jidosha Kabushiki Kaisha, Aichi, Japan

[21] Appl. No.: 61,289

[22] Filed: Jun. 12, 1987

[30] Foreign Application Priority Data

Jun. 26, 1986 [JP] Japan ..... 61-148071
Feb. 4, 1987 [JP] Japan ..... 62-022584

[51] Int. Cl.[4] ..... F02D 9/02
[52] U.S. Cl. ..... 123/399; 123/361
[58] Field of Search ..... 123/339, 340, 342, 361, 123/399

[56] References Cited

U.S. PATENT DOCUMENTS 3,201,648 8/1965 Kerr ..... 123/361 X
4,548,176 10/1985 Ishida et al. ..... 123/342
4,586,471 5/1986 Horada et al. ..... 123/399
4,703,823 11/1987 Yogo et al. ..... 123/399 X

FOREIGN PATENT DOCUMENTS 25853 5/1983 Japan .
122742 7/1984 Japan .
190440 10/1984 Japan .

*Primary Examiner*—Tony M. Argenbright
*Attorney, Agent, or Firm*—Parkhurst, Oliff & Berridge

[57] ABSTRACT

A control apparatus of a throttle valve in an internal combustion engine having a manually operable accelerator pedal. The control apparatus comprises a spring biasing the throttle valve in the opening direction, a first operating mechanism including an accelerator link mechanically connected to the accelerator pedal and a second operating mechanism including an electric motor. The first and second operating mechanisms can operate the throttle valve against the spring and independently of each other, the first operating mechanism thereby defining an upper limit of the degree of opening of the throttle valve in a predetermined relationship with the degree of depression of the accelerator pedal, and the second operating mechanism defining the degree of opening of the throttle valve within that upper limit.

17 Claims, 8 Drawing Sheets

CONTROL APPARATUS OF A THROTTLE VALVE IN AN INTERNAL COMBUSTION ENGINE

BACKGROUND OF THE INVENTION

1. Field of the Invention

The present invention relates to a control apparatus of a throttle valve in an internal combustion engine. More specifically, the present invention relates to a control apparatus of a throttle valve which can be operated by an electric motor.

2. Description of the Related Art

It is well known to control the speed of an automobile by depressing an accelerator foot pedal. The accelerator pedal is generally connected to a throttle valve in an internal combustion engine on the automobile by a cable or the like.

In contrast, it is also known to separate the throttle valve from the accelerator pedal, to provide a detecting means for detecting the degree of depression of the accelerator pedal, and to control the throttle valve by an electric motor in response to an output of the detecting means.

For example, Japanese Examined Patent Publication No. 58-25853 discloses a control apparatus of a throttle valve in an internal combustion engine, in which an electric motor controls a throttle valve through a control circuit which receives detection signals from an accelerator pedal position detector, a water temperature sensor and a throttle position detector. A problem in the motor driven control apparatus of a throttle valve as described in Japanese Examined Patent Publication No. 58-25853, is that it is necessary to provide a compensating device to ensure that the throttle valve is brought to an appropriate opening position, in the event that a malfunction of the throttle valve control motor occurs, in which case the engine could become uncontrollable.

Therefore, a clutch is provided between the motor and the throttle valve in this Publication. However, a further problem occurs in that the engine operation is stopped if a malfunction of the motor occurs.

Japanese Unexamined Patent Publication No. 59-122742 discloses a control apparatus of a throttle valve in an internal combustion engine with a compensating device, in which the apparatus includes a throttle valve with a spring biasing the throttle valve in the closing direction, an electric motor with an output wheel which is connected to the throttle valve via a cable and has a side projection, and an coaxial extra wheel connected to an accelerator pedal via a cable and having a side projection, the side projections being provided at angularly spaced positions. The extra wheel is rotatable relative to the output wheel. When the motor operates normally, there is no interference between the projections, and thus the motor can easily control the throttle valve through a control means. If the motor fails, the side projection of the motor output wheel are returned to the initial position in the anti-clockwise direction by the throttle return spring, while, by depressing the accelerator pedal, the side projection of the extra wheel can be turned in the clockwise direction to abut against the projection and ensure a minimum opening of the throttle valve. However, there is a still problem in the mechanism described in this publication in that the throttle valve cannot be opened until the accelerator pedal is further depressed, and the mechanism itself cannot work after the throttle valve is fully opened by the motor.

Also, Japanese Unexamined Patent Publication No. 59-190440, in an attempt to solve the same problems, discloses a control apparatus of a throttle valve, which includes a throttle valve with a throttle shaft, an electric motor connected to one end of the throttle shaft, and a compensating mechanism located at the other end of the throttle shaft. The compensating mechanism includes a segmental lever having a hub portion which is freely inserted over the throttle shaft, a small arm which is biased by a spring in a certain direction (valve closing direction), and a large segmental arm which is connected to the accelerator pedal by a cable. This segmental arm has a side projection, and the throttle shaft has a movable plate fixed at the end of the shaft. When the accelerator pedal is depressed, the segmental arm with the side projection is pulled, and the side projection moves away from the movable plate on the throttle shaft so that the motor can control the throttle valve in response to an output from an accelerator potentiometer. However, if the motor loses its control facility, the side projection of the segmental arm, by releasing the accelerator pedal, can abut against and force the projection back to the initial closed position of the throttle valve. There is, however, a problem in this mechanism in that the throttle valve cannot be opened again after it is once closed if the motor cannot output the control torque.

SUMMARY OF THE INVENTION

It is an object of the present invention to provide a control apparatus of the throttle valve in an internal combustion engine which can solve the above problems and be reliably controlled by an electric motor.

According to the present invention, there is provided a control apparatus of a throttle valve in an internal combustion engine having a manually operable accelerator means, said control apparatus comprising: a spring means biasing the throttle valve in the direction in which the throttle valve is caused to open; a first operating means mechanically connected to the manually operable accelerator means and engageable with the throttle valve against the spring means for restricting the opening position of the throttle valve; and, a second operating means engageable with the throttle valve against the spring means independently of the first operating means for restricting the opening position of the throttle valve; whereby the first operating means can define an upper limit of the degree of opening of the throttle valve in a predetermined relationship with the degree of operation of the manually operable accelerator means, and the second operating means can define the degree of opening of the throttle valve within an upper limit.

In the preferred form, the first operating means comprises an accelerator link connected to the manually operable accelerator means through a wire means, and the second operating means comprises an electric motor means having an output shaft and a motor lever secured to the output shaft, the accelerator link and the motor lever being independently engageable with said throttle valve. Preferably, the throttle valve is secured to a throttle shaft and a throttle lever is secured on the end of the throttle shaft, the accelerator link and the motor lever being engageable with the throttle lever. The throttle lever preferably comprises a generally straight double arm lever having a first arm and a second arm extending in opposite directions from the throttle shaft, the accelerator link being able to engage with the first arm on the side where the accelerator link can resist the spring means when the accelerator link is engaged with the throttle lever, and the motor lever being able to engage with the second arm on the side which is apart from the accelerator link but identical, from the rotational sense, to that of the throttle lever to the accelerator link.

It will be understood that the most important feature of the present invention resides in the provision of the throttle return spring which biases the throttle valve in the direction in which the throttle valve is caused to open. Under the action of this return spring, it is sufficient to restrict the opening position of the throttle valve to place it at a desired position, which allows two different operating means to easily control the throttle valve.

The first and second operating means can independently and alternatively engage with the throttle valve. When the second motor driven operating means is normally engaged with the throttle valve, the first mechanical operating means can work as a compensating means to enable the engine to operate even if the motor fails. This arrangement is embodied in a preferred form, wherein the detecting means includes means for detecting the degree of operation of the manually operable accelerator means and the electric motor is controlled to define the degree of opening of the throttle valve in a further relationship with the degree of operation of the manually operable accelerator means, separately predetermined from the first relationship for the first operating means, so that the motor lever of the second operating means normally engages with the throttle lever to bring the throttle valve into the desired open position, and the accelerator link of the first operating means floats above the throttle lever when the throttle valve is at said desired open position, the accelerator link being able to receive the throttle lever at said upper limit position if the control of the electric motor is lost.

Alternatively, when the first mechanical operating means is normally engaged with the throttle valve, the second motor driven operating means can work as a compensating means to bring the throttle valve into a further closed position. This arrangement is embodied in the preferred form, wherein the accelerator link of the first operating means normally engages with the throttle lever, and the detecting means includes means for detecting the output power of the engine, the electric motor being driven to restrict the throttle opening from that defined by the first operating means only when an excessive power output by the engine is detected.

As explained above, according to the present invention, it is possible to obtain a control apparatus of a throttle valve in an internal combustion engine which has a simple construction and low cost and which makes it possible to easily effect mechanical and electrical operations in parallel for the common throttle valve. Especially, the throttle valve does not open beyond the upper limit opening degree as defined in relation to the accelerator pedal, and thus is reliable from the safety viewpoint when controlled electrically.

BRIEF DESCRIPTION OF THE DRAWINGS

Other features and advantages of the present invention will be understood from the following description of the preferred embodiments and the attached drawings, in which.

DESCRIPTION OF THE PREFERRED EMBODIMENTS

Figure 1:
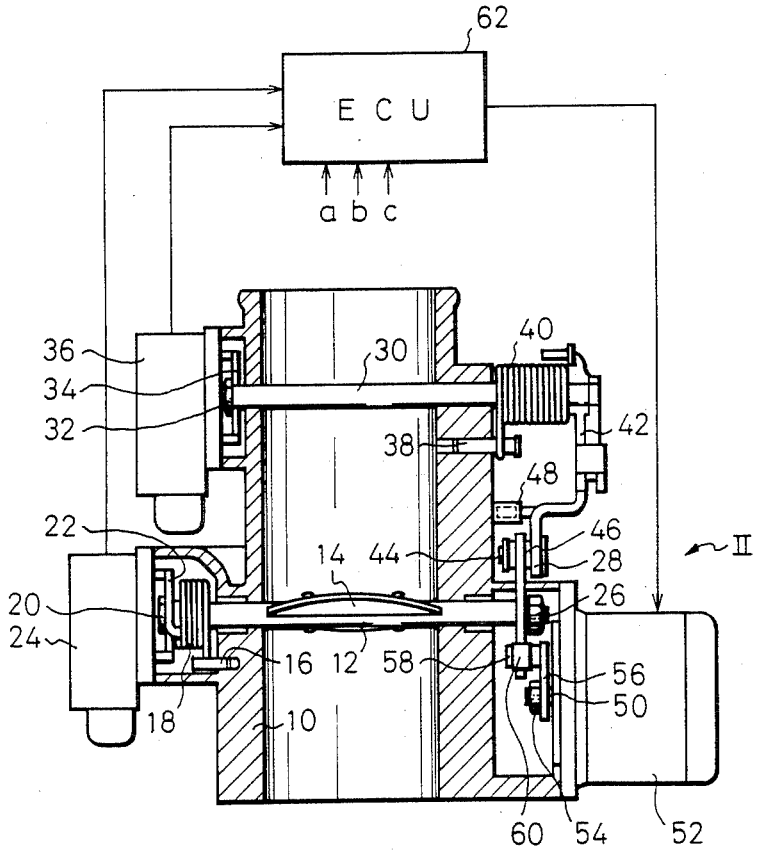
FIG. 1 illustrates a control apparatus of a throttle valve in an internal combustion engine according to the first embodiment of the present invention.
Figure 2:
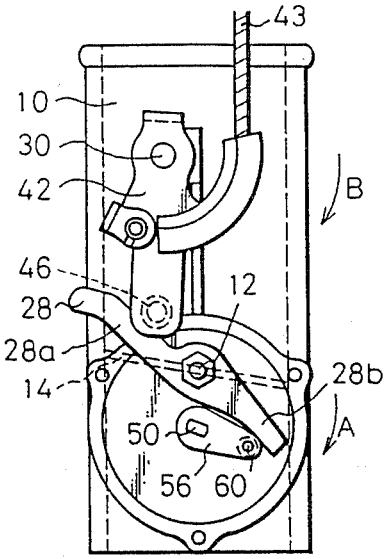
FIG. 2 is a front elevation of the control apparatus of FIG. 1 as viewed from the arrow II of FIG. 1 with the electric motor omitted.

FIGS. 1 and 2 illustrate a control apparatus of a throttle valve in an internal combustion engine according to the present invention. Reference numeral 10 designates a throttle body arranged in an intake system in an internal combustion engine, in which a rotable throttle valve 14 is fixedly secured to a throttle shaft 12. The throttle shaft 12 is provided at one end thereof with a coil spring 18, one end of which is fixed to the end of the shaft and the other end is fixed to a pin 16 fixed to the body 10. Accordingly, this spring 18 can bias the throttle valve 14 in the direction in which the throttle valve 14 is made to open (in the direction indicated by the arrow A in FIG. 2). The throttle shaft 12 is also provided, at the same end thereof, with a lever 22 fastened by a nut 20, and a throttle position sensor 24 is provided to detect the position of the lever 22. A throttle lever 28 is firmly secured by a nut 26 to the other end of the throttle shaft 12.

A shaft 30, connected to an accelerator pedal, rotatably extends through the throttle body 10 in parallel to the throttle shaft 12. The shaft 30 is provided at one end thereof with a lever 34 fastened by a nut 32 and sensor 36 is provided to detect the position of the lever 34. The shaft 30 is provided at the other end thereof with a second coil spring 40, one end of which is fixed to the end of the shaft 30 and the other end is fixed to a pin 38 fixed to the body 10. Accordingly, this second coil spring 40 biases the shaft 30 in the clockwise direction, as indicated by the arrow B in FIG. 2. The shaft 30 is also provided, at the end and outside of the second spring 40, with an accelerator link 42, which is connected to an accelerator pedal (not shown) by a cable 43. The accelerator link 42 rotates together with the shaft 30 around the axis thereof, and has a free end to which a pin 44 is fixed by a rotatable roller 46.

As can be clearly seen in FIG. 2, the above described throttle lever 28 comprises a generally straight double arm lever comprising arms 28*a* and 28*b*, with the throttle shaft 12 constituting a fulcrum thereof. The accelerator link 42 is arranged relative to the throttle lever 28 in such a manner that the roller 46 can engage one side of the arm 28*a* of the throttle lever 28. As can be seen in FIG. 1, a stopper 48 is fixedly provided to receive the accelerator link 42 at a position in which the throttle valve is fully closed.

Further, an electric step motor 52 mounted on the throttle body 10 has an output shaft 50 extending in parallel to the throttle shaft 12. A motor lever 56 is fixed to the output shaft 50 of the motor 52 by a nut 54. The motor lever 56 has a free end to which a pin 58 is fixed to carry a rotatable roller 60, the pin 58 and the roller 60 extending in the same orientation as the pin 44 and the roller 46. This roller 60 can engage with the second arm 28*b* of the throttle lever 28 on the other side from the roller 46.

Figure 7:
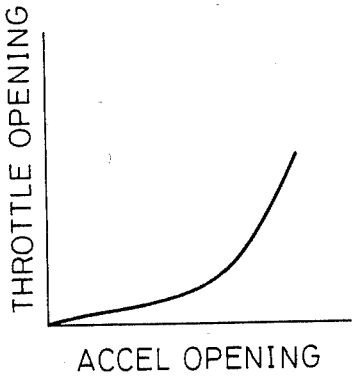
FIG. 7 is a view illustrating the relationship between the degree of opening of the accelerator and the degree of opening of the throttle during a normal operating condition.

An electric control unit (ECU) 62 is provided to control the electric step motor 52 in accordance with the operating condition of the engine. The ECU 62 receives output signals from the sensor 36 which detects the degree of depression of the accelerator pedal 8 and the throttle sensor 24 which detects the degree of opening of the throttle valve 14, as well as signals representing the engine operating condition such as a signal a representing the idling of the engine, a signal b representing the r.p.m. of the engine, and a signal c representing the temperature of the engine coolant. The ECU 62 in this embodiment controls the step motor 52 so as to define the throttle opening of the throttle valve 14 in correspondence mainly with the degree of depression of the accelerator pedal. It is not, however, necessary to determine the throttle degree of opening of the throttle valve 14 in a linear relationship with the degree of depression of the accelerator pedal, but it is possible to determine any desired relationship. For example, it possible to determine the relationship, as shown in FIG. 7, in which the rate of change of the degree of opening of the throttle relative to the degree of depression of the accelerator pedal is relatively small in a small acceleration region and becomes rapidly large in a large acceleration region. This can be carried out by storing the characteristics of FIG. 7.

The operation of the control apparatus of the throttle valve 14 is now described.

The spring force of the spring 18, which opens the throttle valve 14, is selected to be lower than the torque of the step motor 52 when power is supplied and greater than the torque of the step motor 52 when power is cut off. Also, the spring force of the second spring 40, which closes the throttle valve 14 through the accelerator link 42 and the throttle lever 28, is sufficiently greater than the spring force of the spring 18 that, when the accelerator pedal is not depressed, and thus the cable 43 is not under tension, the second spring 40 causes the accelerator link 42 and thus the throttle valve 14 to be fully closed against the spring 18. FIG. 2 shows the throttle valve 14 in such a fully closed state. It will be thus easily understood that the accelerator link 42 mechanically connected to the accelerator pedal and the motor lever 56 connected to the motor 52 act, independently of each other, on the throttle valve 14 in the closing direction against the opening spring 18.

FIGS. 2 to 5 show an embodiment in which the motor 52 is normally driven in response to the output from the sensor 36. In this embodiment, the motor 52 and the motor lever 56 primarily control the throttle valve 14, and the accelerator link 42 mechanically connected to the accelerator pedal acts in a secondary capacity as a safety guard.

Figure 3:
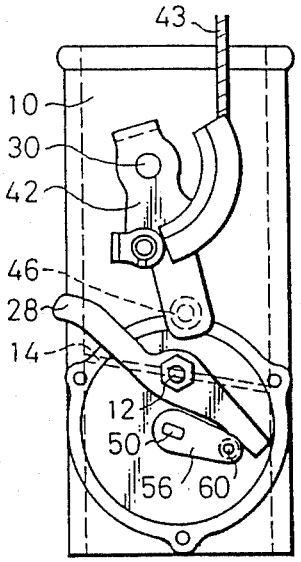
FIGS. 3 to 5 are views similar to FIG. 2 but showing different operating states, respectively.
Figure 4:
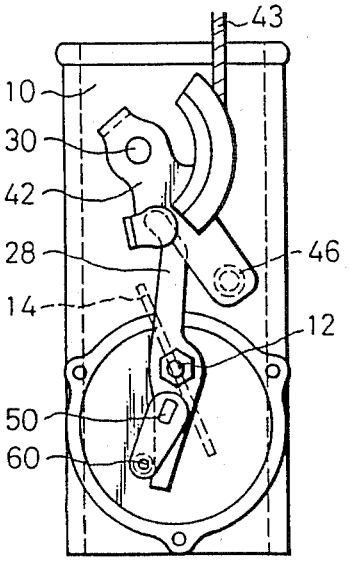

When the accelerator pedal is depressed from the fully closed valve position shown in FIG. 2, the accelerator link 42 first follows the action of the accelerator pedal and rotates against the second spring 40. Instantaneously, the accelerator link 42 is separated from the throttle lever 28, as shown in FIG. 3. Then the force of the spring 18 is exerted to open the throttle valve 14, and a control signal is delivered to the step motor 52 in response to the degree of depression of the accelerator pedal, and thus the motor lever 56 connected to the step motor 52 is rotated by a selected angle. The throttle lever 28 thus follows the action of the motor lever 56 when it is urged by the spring 18. It will be clear from the above description that the step motor 52 and the motor lever 56 restrict the degree of opening of the throttle valve 14 against the spring 18. In this situation, as shown in FIG. 4, the throttle lever 28 can establish a relatively large rotating angle although the rotating angle of the accelerator link 42 is relatively small, with the roller 46 of the accelerator link 42 still separated from the throttle lever 28, due to the arm ratio between the accelerator link 42 and the throttle lever 28 as well as the characteristic configurations thereof. This relationship is maintained when the angles of the accelerator link 42 and the throttle lever 28 are changed. Thus it is possible to control the opening of the throttle valve 14 solely by the step motor 52.

Figure 5:
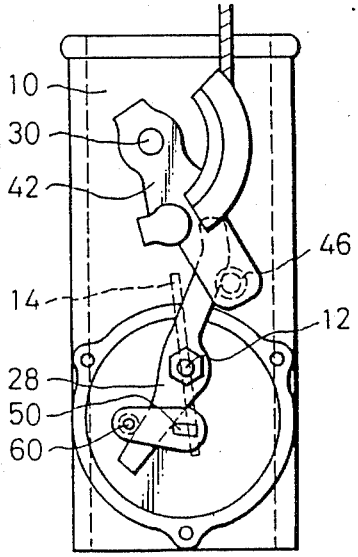

The throttle valve 14 is brought to the fully closed position by the second spring 40 having a greater spring force, as previously explained, when the accelerator link 42 is in the fully closed position. During the operation of the throttle valve 14, the accelerator link 42 is separated from the throttle lever 28, but this separation also depends on the degree of depression of the accelerator pedal. It can be understood that control of the throttle valve 14 is lost and it tends to further open if the control torque of the step motor 52 is lost, since the throttle valve 14 is biased on the opening direction by the spring 18. In this situation, as shown in FIG. 5, the throttle lever 28 is received by the roller 46 of the accelerator link 42 at that specific position and the opening of the throttle valve 14 is prevented from becoming excessive. In this way, the accelerator link 42 defines the upper limit of the opening angle of the throttle valve 14. Further, in an emergency, it is possible to control the throttle valve 14 by the accelerator link 42.

Figure 6:
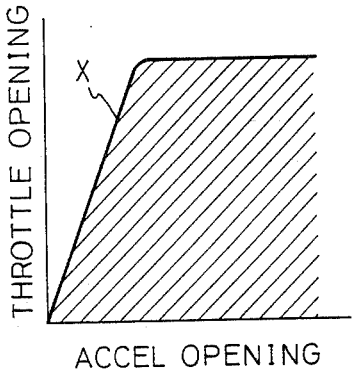
FIG. 6 is a view illustrating the upper limit control position of the throttle valve.

Referring to FIG. 6, the curved line X indicates a relationship between the accelerator opening and the throttle opening when the accelerator link 42 is operated when in contact with the throttle lever 28. In an emergency, the throttle opening is controlled along the curved line X. In normal operation, the accelerator link 42 is separated from the throttle lever 28 and the throttle valve 14 is controlled by the step motor 52. The controlled throttle opening effected by the step motor 52 can be appropriately in relation to the accelerator opening, selected from the region indicated by the hatching in FIG. 6 under the curved line X. FIG. 7 is an example of this relationship. It is possible, according to the present invention, for a driver to continue to drive even if a malfunction of the step motor 52 of the ECU 62 occurs, and to recognize that such a malfunction has occurred because of a change in the torque, since the throttle valve 14 opens to a greater extent than that intended in relation to the degree of depression of the accelerator pedal, from the pedal feeling, since the spring 18, when the accelerator 42 engages with the throttle lever 28, acts to mitigate the force of the second spring 40 to give a light pedal feeling.

FIGS. 8 to 11 show a second embodiment according to the present invention. The first embodiment, shown in FIGS. 1 to 5, comprises the step motor 52 which is normally driven in accordance with the output signal mainly from sensor 36, and thus primarily controls the throttle valve 14 with the accelerator link 42 mechanically connected to the accelerator pedal acting as a safety guard. This second embodiment, shown in FIGS. 8 to 11, comprises an accelerator link 42 mechanically connected to the accelerator pedal which primarily controls the throttle valve 14 with a step motor 52 temporarily actuated only when the power of the engine must be decreased.

Figure 8:
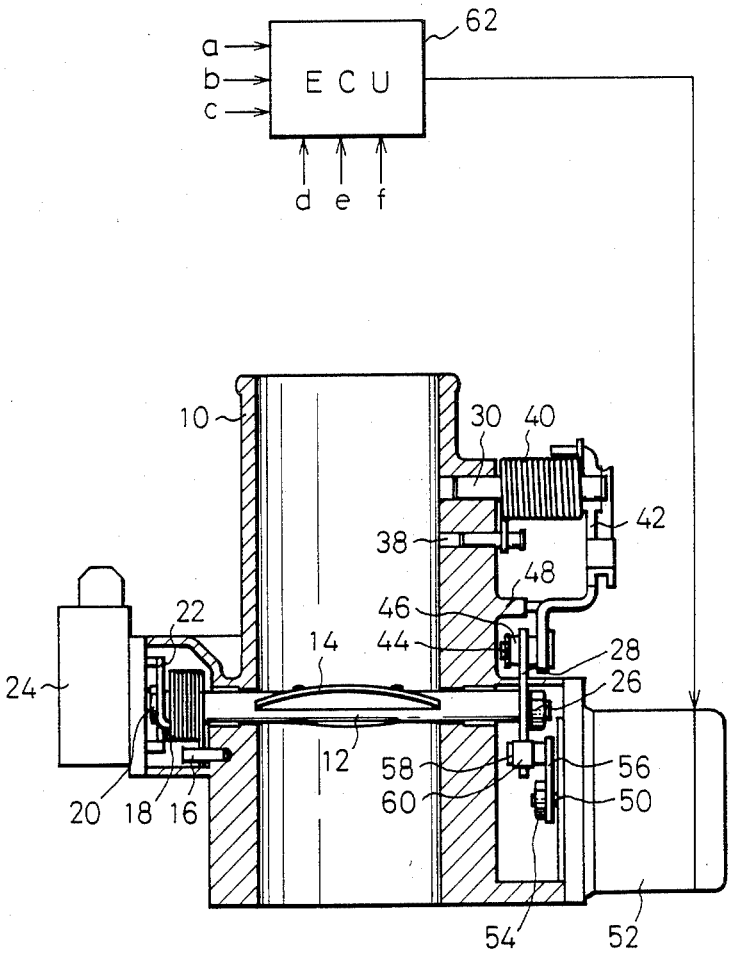
FIG. 8 illustrates a control apparatus of a throttle valve in an internal combustion engine according to the second embodiment of the present invention.
Figure 9:
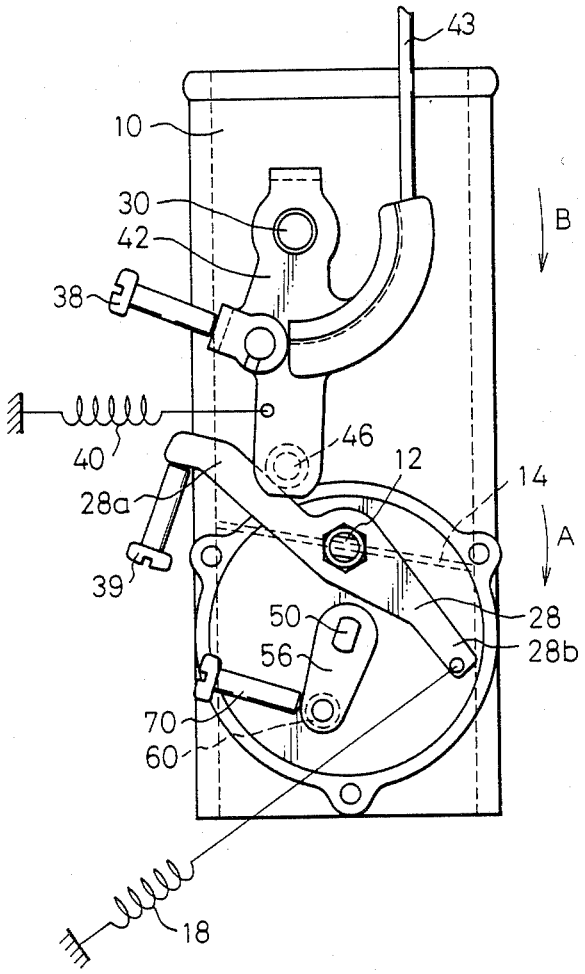
FIG. 9 is a front elevation of the control apparatus of FIG. 8.

Referring to FIGS. 8 and 9, the fundamental arrangement is similar to the previous embodiment and comprises a spring 18 biasing the throttle valve 14 in the opening direction thereof, a throttle lever 28 connected to the throttle valve 14, an accelerator link 42, and a motor lever 56 connected to an electric step motor 52. Also, the accelerator link 42 and the motor lever 56 can both engage with the throttle lever 28 from the direction in which the throttle valve 14 is closed. However, the sensor as shown in FIG. 1 is not provided, but alternatively, the electric control unit (ECU) 62 receives, in addition to the previously described engine operating condition detecting signals such as an idling signal a, engine revolution signal b, water temperature signal c, signals d, e, and f representing the working condition of the automobile. These signals d, e and f detect the condition in which it is necessary to decrease the output power of the engine, for example, by detecting wheel slip due to an excessive power output by the engine during a start or acceleration of the automobile or gear change in an automatic transmission.

Figure 12:
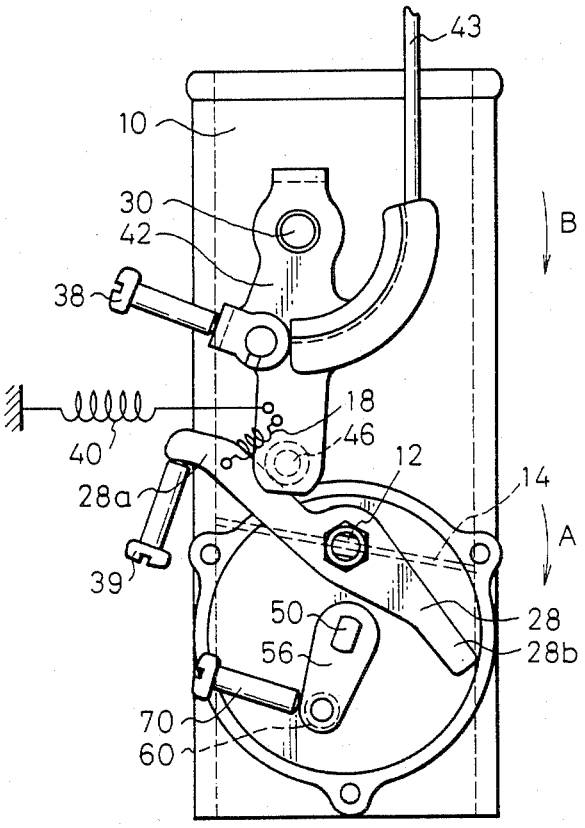

Although the springs 18 and 40 are shown connected to the throttle lever 28 and the accelerator link 42, respectively, in FIG. 9, it will be understood that they can work in a similar manner if they are mounted around the shafts 12 and 30, respectively, as shown in FIG. 8. Also, the spring 18 can be connected between the throttle lever 28 and the accelerator link 42, as shown in FIG. 12.

As shown in FIG. 9, the motor lever 56 usually rests on a stopper 70 provided at a position corresponding to the fully open position of the throttle valve 14, and is not normally engaged with the throttle lever 28. Therefore, the throttle lever 28 is controlled by the accelerator link 42, to restrict the throttle opening. In this case too, the throttle opening can be determined in relation to the accelerator opening, for example, a relation can be selected from lines X, Y and Z in FIG. 11, which can be determined as desired by, for example, modifying the arm ratio of the levers or the configuration of the engaging portion of the throttle lever 28 to the roller 46 of the accelerator link 42. Also in FIG. 11, the motor control region of the throttle valve 14 by the step motor 52 is represented by the hatching under the line Z, assuming that the line Z is selected, the throttle opening controlled by the step motor 52 is thus determined within the upper limit of the line Z.

Figure 10:
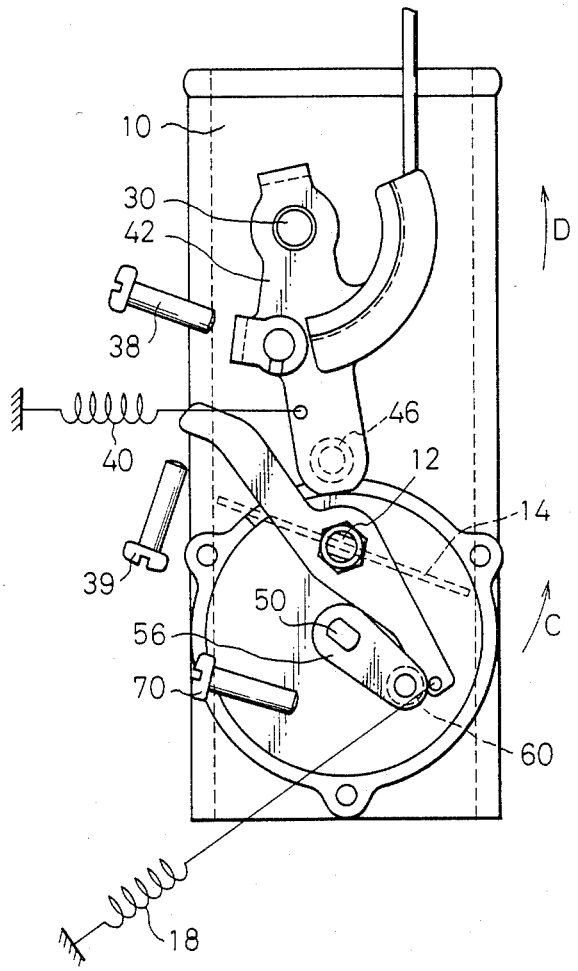
FIG. 10 is a view similar to FIG. 9 but showing a different operating state.
Figure 11:
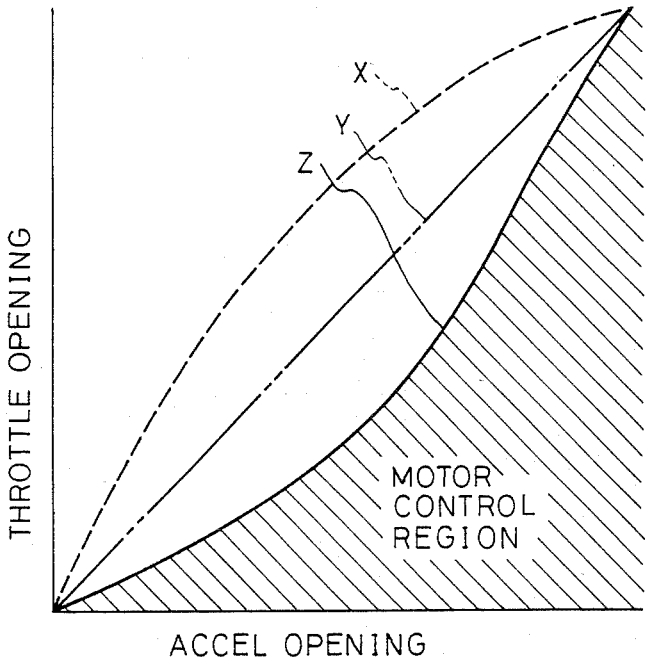
FIG. 11 is a view illustrating the relationship between the degree of opening of the accelerator and the degree of opening of the throttle; and, FIG. 12 is a view similar to FIG. 9 but illustrating the spring in a modified form.

In this way, the throttle valve 14 is normally controlled by the accelerator link 42 and the step motor 52 is driven from the position shown in FIG. 9 to the position shown in FIG. 10 to move the throttle lever 28 with the motor lever 56, when a wheel slip or the like is detected, whereby the throttle lever 28 is separated from the accelerator link 42 and the throttle opening is decreased more than when controlled by the accelerator link 42. The decrease in the throttle opening results in a decrease in the output power of the engine, and the motor lever 56 is then returned to the position shown in FIG. 9 by reversely driving the step motor 52 after the operating condition of the engine is restored.

In this case too, the driver can recognize the occurrence of an excessive power output by the engine despite the operation of the step motor 52, because the accelerator pedal usually receives the spring force that is derived by the second spring 40 minus the spring 18, but the spring force of the spring 18 on the accelerator pedal suddenly disappears on that occasion and the driver can feel the change in the pedal depression force. Also, the throttle opening obtained by the operation of the step motor 52 cannot exceed the upper limit restricted by the accelerator link 42, thus providing a further factor safety. Further, in this case, it is possible to close the throttle valve 14 by releasing the accelerator pedal even if the motor lever 56 locks at a certain position due to, for example, a malfunction of the step motor 52, and it is possible to open the throttle valve 14 by depressing the accelerator pedal to an extent where the motor lever 56 is locked and operates the throttle valve 14 by the usual accelerator feeling within that opening. Especially, in this embodiment, it is possible to control the throttle valve 14 in the closing direction to the desired extent when necessary, and to effect an optimum control of the engine power. It will be understood that it is possible to easily effect the mechanical and electrical operations in parallel for the common throttle valve, and to obtain a control apparatus of a throttle valve in an internal combustion engine which has a simple construction and a low cost.

We claim:

1. A control apparatus of a throttle valve in an internal combustion engine having a manually operable accelerator means, said control apparatus comprising:

a spring means biasing said throttle valve in the direction in which said throttle valve is caused to open;

a first operating means mechanically connected to said manually operable accelerator means and selectively engageable with said throttle valve against said spring means for restricting the opening position of said throttle valve; and a second operating means selectively engageable with said throttle valve against said spring means independently of said first operating means for restricting the opening position of said throttle valve;

said first operating means and said second operating means being engageable with said throttle valve independently of and parallel to each other to determine a throttle opening of said throttle valve by one of said first and second operating means being engaged with said throttle valve, the other of said first and second operating means being disengaged from the throttle valve;

said other disengaged operating means thereby defining an upper limit of a degree of opening of said throttle valve, and said one engaged operating means defining the degree of opening of said throttle valve within said upper limit.

2. A control apparatus according to claim 1, wherein said first operating means comprises an accelerator link connected to said manually operable accelerator means through a linkage member, and said second operating means comprises an electric motor means having an output shaft and a motor lever secured to said output shaft, said accelerator link and said motor lever being independently engageable with said throttle valve.

3. A control apparatus according to claim 2, wherein said linkage member comprises a cable.

4. A control apparatus according to claim 2, wherein said throttle valve is secured to a throttle shaft having a throttle lever secured thereto, said accelerator link and said motor lever being engageable with said throttle lever.

5. A control apparatus according to claim 3, wherein said spring means is fastened at one end thereof to said throttle shaft and at the other end thereof to a stationary part of the engine.

6. A control apparatus according to claim 3, wherein said spring means is fastened at one end thereof to said throttle lever and at the other end thereof to a stationary part of the engine.

7. A control apparatus according to claim 3, wherein said spring means is fastened at one end thereof to said throttle lever and at the other end thereof to said accelerator link.

8. A control apparatus according to claim 4, wherein said throttle lever comprises a generally straight double arm lever having a first arm and a second arm extending in opposite directions from said throttle shaft, said accelerator link being able to engage with said first arm on the side where said accelerator link can resist said spring means when said accelerator link is engaged with said throttle lever, and said motor lever being able to engage with said second arm on the side which is apart from the accelerator link but identical from the rotational sense of said throttle lever to the accelerator link.

9. A control apparatus according to claim 3, wherein said accelerator link is biased by a second spring means in the direction in which said throttle valve is caused to close when said accelerator link is engaged with said throttle lever, said second spring means having a spring force greater than that of said first spring means, whereby said throttle valve is returned to a closed position by the action of said second spring means when said manually operable accelerator means is released.

10. A control apparatus of a throttle valve in an internal combustion engine having a manually operable accelerator means, said control apparatus comprising:

a spring means biasing said throttle valve in the direction in which said throttle valve is caused to open;

a first operating means mechanically connected to said manually operable accelerator means and selectively engageable with said throttle valve against said spring means for restricting the opening position of said throttle valve, said first operating means comprising an accelerator link connected to said manually operable accelerator means through a cable;

detecting means for detecting the operating condition of said engine;

a second operating means selectively engageable with said throttle valve against said spring means independently of said first operating means and operable in accordance with a control signal obtained in response to an output from said detecting means for restricting the opening position of said throttle valve, said second operating means comprising an electric motor means having an output shaft and a motor lever secured to said output shaft; and, said throttle valve being secured to a throttle shaft having a throttle lever secured thereto, said accelerator link and said motor lever being independently engageable with said throttle lever;

said first operating means and said second operating means being engageable with said throttle valve independently of and parallel to each other to determine a throttle opening of said throttle valve by one of said first and second operating means being engaged with said throttle valve, the other of said first and second operating means being disengaged from the throttle valve;

said other disengaged operating means thereby defining an upper limit of a degree of opening of said throttle valve and said one engaged operating means defining the degree of opening of said throttle valve within said upper limit.

11. A control apparatus according to claim 10, wherein said spring means is fastened at one end thereof to said throttle shaft and at the other end thereof to a stationary part of the engine.

12. A control apparatus according to claim 10, wherein said spring means is fastened at one end thereof to said throttle lever and at the other end thereof to a stationary part of the engine.

13. A control appears according to claim 10, wherein said spring mean is fastened at one end thereof to said throttle lever and at the other end thereof to said accelerator link.

14. A control apparatus according to claim 10, wherein said throttle lever comprises a generally straight double arm lever having a first arm and a second arm extending in opposite directions from said throttle shaft, said accelerator link being able to engage with said first arm on the side where said accelerator link can resist said spring means when said accelerator link is engaged with said throttle lever, and said motor lever being able to engage with said second arm on the side which is apart from the accelerator link but identical from the rotational sense of said throttle lever to the accelerator link.

15. A control apparatus according to claim 10, wherein said accelerator link is biased by a second spring means in the direction in which said throttle valve is caused to close when said accelerator link is engaged with said throttle lever, said second spring means having a spring force greater than that of said first spring means, whereby said throttle valve is returned to a closed position by the action of said second spring means when said manually operable accelerator means is released.

16. A control apparatus according to claim 10, wherein said detecting means includes means for detecting the degree of operation said manually operable accelerator means and said electric motor is controlled to define the degree of opening of said throttle valve in a further relationship with the degree of operation of said manually operable accelerator means, separately predetermined from said first relationship for said first operating means, so that said motor lever of said second operating means normally engages with said throttle lever to bring the throttle valve to the desired open position, and said accelerator link of said first operating means floats above said throttle lever when said throttle valve is at said desired open position, said accelerator link being able to receive said throttle lever at said upper limit position if control of said electric motor is lost.

17. A control apparatus according to claim 10, wherein said accelerator link of said first operating means normally engages with said throttle lever, and said detecting means includes means for detecting the condition in which the output power of the engine must be decreased, said electric motor being driven to restrict the throttle opening from that opening defined by said first operating means only when an excessive power output by said engine is detected.

* * * * *